United States Patent [19]

DesPortes

[11] Patent Number: 4,940,445

[45] Date of Patent: Jul. 10, 1990

[54] TIRE AND PROCESS FOR MAKING A TIRE

[76] Inventor: Aubrey S. DesPortes, 184 Belle Lindler Rd., Gilbert, S.C. 29054

[21] Appl. No.: 413,112

[22] Filed: Sep. 27, 1989

[51] Int. Cl.[5] ..... A63H 17/00; B32B 31/00; B60C 7/00; B60B 1/06

[52] U.S. Cl. ..... 446/465; 156/113; 156/153; 156/96; 152/323; 152/313; 301/63 PW

[58] Field of Search ..... 446/465, 431, 454, 456; 156/113, 112, 153, 294, 303.1, 96; 152/323, 310, 311, 313; 301/63 PK; 264/46.7

[56] References Cited

U.S. PATENT DOCUMENTS

| | | | |
|---|---|---|---|
| 2,228,212 | 1/1941 | Heintz | 156/153 X |
| 3,408,770 | 11/1968 | Smolinski et al. | 446/465 |
| 3,835,583 | 9/1974 | Manning | 446/465 |
| 3,846,201 | 11/1974 | Huskins | 152/323 X |
| 3,915,774 | 10/1975 | Dobson | 156/113 |
| 3,987,832 | 10/1976 | Funke | 152/323 X |
| 4,157,930 | 6/1979 | Bjorkman et al. | 156/96 |
| 4,176,702 | 12/1979 | Seiberling | 156/96 X |
| 4,240,851 | 12/1980 | King | 156/96 |
| 4,269,644 | 5/1981 | Goldstein | 156/96 |
| 4,274,897 | 6/1981 | Barefoot | 156/96 |

FOREIGN PATENT DOCUMENTS

| | | | |
|---|---|---|---|
| 0093602 | 6/1983 | Japan | 152/323 |

OTHER PUBLICATIONS

Vulcanization & Vulcanizing Agents, Werner Hofmann, Palmerton Publishing Co., New York, 1967 (translation).

*Primary Examiner*—Robert A. Hafer
*Assistant Examiner*—D. Neal Muir
*Attorney, Agent, or Firm*—Michael A. Mann

[57] ABSTRACT

A tire and method of making a tire by attaching a rubber material to a foam core to form an intermediate composite, placing the intermediate composite in mold, then heat during the composite so that the rubber fills the mold and fuses to the surface of the foam core. The tire can be made on a wheel by gluing a foam strip around the wheel, then sanding the foam to a desired tolerance, gluing with rubber cement at least one layer of the rubber material and then curing at a temperature between 180 and 300 degrees Fahrenheit for 40 to 60 minutes. For small scale tires such as those used on remotely operated race cars, the tires are preferably partially cured to increase traction.

12 Claims, 2 Drawing Sheets

44
42
42
40

14
12
10

TIRE AND PROCESS FOR MAKING A TIRE

BACKGROUND OF THE INVENTION

1. Field of the Invention

The present invention relates to making tires. More specifically, the present invention relates to making foam core tires.

2. Discussion of Background

The use of foam in tires is not new. See for example U.S. Pat. Nos. 4,033,395, 3,952,786, 1,476,878 and 1,371,427. Foam filled or solid tires have several advantages over air-filled tires: punctures of such tires do not lead to a tire geometry and control as with air-filled tires. However, foam-filled tires have problems with slippage between foam and casing which can result in a material or geometric deterioration from friction at high speeds.

In the field of scale model vehicles, the selection of tires has been limited to solid tires made entirely of rubber, or a rubber material. Scale model, remotely-operated racing cars with such tires have difficulty holding curves above 40 miles per hour. Solid rubber tires, on such vehicles as riding lawn mowers do not give a smooth ride; air filled tires for such vehicles are relatively expensive because of the need to provide stability in the form of internal belts.

There is a need for a tire that provides the cushioning of air-filled tires but is unaffected by punctures and has good material and geometric stability at the speed of use.

SUMMARY OF THE INVENTION

According to its major aspects, a tire is made by attaching a layer of rubber material around a foam core to make an intermediate composite, then heat during the intermediate composite in a mold so that the curing rubber material fuses with the surface of the expanding foam core. The tire can be made directly on a wheel by gluing a strip of foam around the wheel, sanding the foam to a desired tolerance, then gluing at least one layer of uncured rubber around the foam with rubber cement and curing at a temperature between 180 and 300 degrees Fahrenheit for 40 to 60 minutes. For small scale race cars, partially curing the tire by heating to a temperature between 180 and 232 degrees for 40 to 50 minutes will produce a tire that has good road hugging capability and will hold a curve at 60 miles per hour.

It is a feature of the present invention that the rubber material fuses into the foam core, providing a slip-resistent bond between the two. The advantage of such a bond is the reduction of frictional heat buildup in the interface.

Another feature of the present invention is the lighter weight, and more cushioned ride of a tire made with a foam core rather than a solid rubber core. For riding lawn mowers, where speed is not required, such tires are less expensive than solid rubber and air-filled tires.

Yet another feature of the present invention is for tires used on surfaces where punctures are a particular problem, such as on landfills and construction sites, foam filled tires are a highly desirable alternative to solid or air-filled tires.

These and other features and advantages of the present invention will be apparent to those skilled in the art from a review of the drawings and a reading of the detailed description of a preferred embodiment that follow hereafter.

A BRIEF DESCRIPTION OF THE DRAWINGS

The accompanying drawings, which are incorporated in and form a part of the specification, illustrate the invention and, together with the description, serve to explain the principles of the invention. In the drawings.

DETAILED DESCRIPTION OF THE INVENTION

Figures 1, 5:
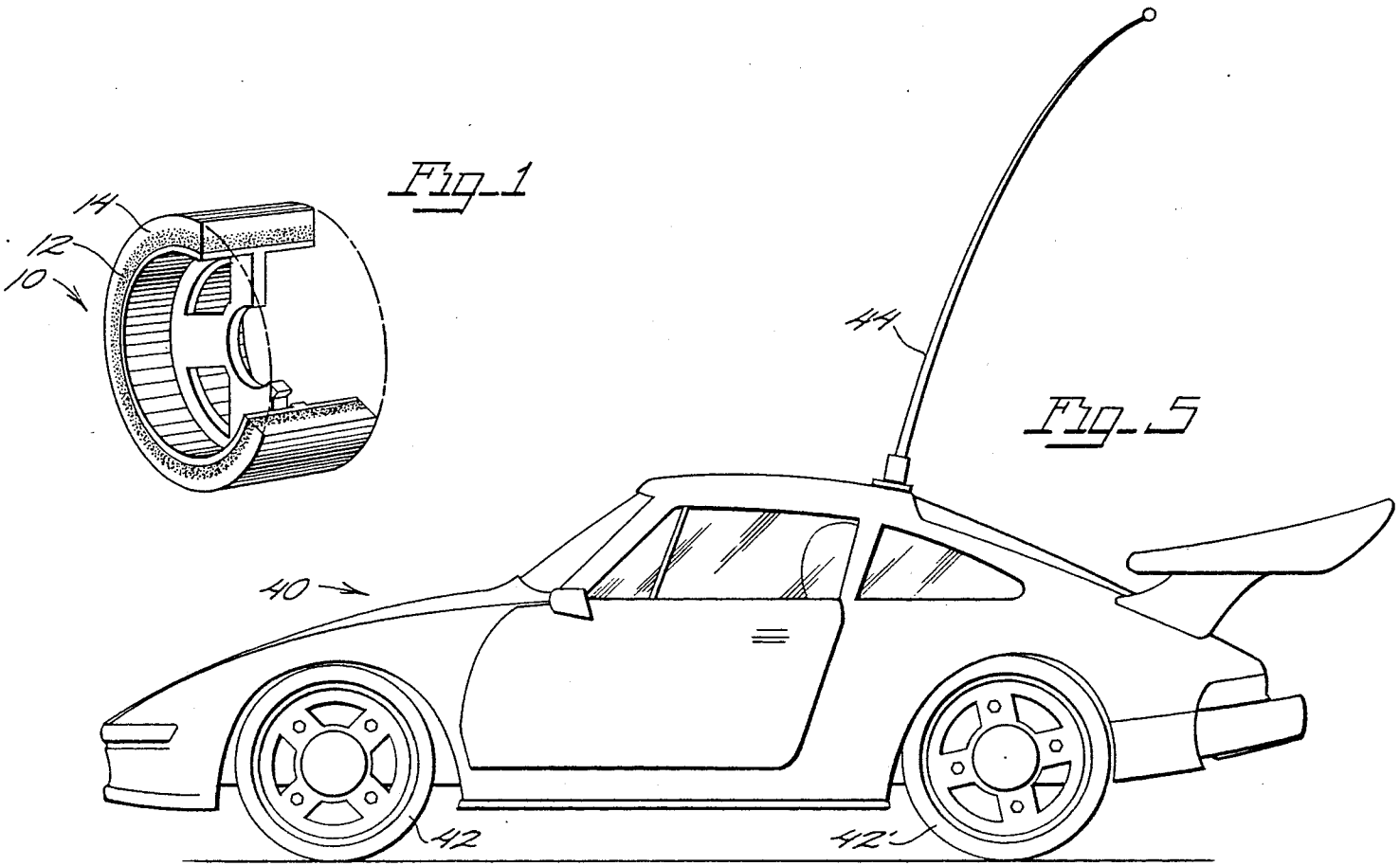
FIG. 1 is a perspective view of a tire according to the present invention with part of the tire and wheel cut away.
FIG. 5 is a side view of an example of a radio controlled, remotely operated car according to the present invention.

The present invention is a tire and method for making a tire. The tire may be of any size, from super scale tires such as those used for earth moving machines to subscale tires such as those used in remote controlled racing cars, wheel barrows, lawn mowers, especially riding lawn mowers, utility vehicles, trailers , and so on. Tires made according to the present invention are especially suited for low speeds and infrequent use, where either stability provided normally by belting in pneumatic tires is not required, or for use on surfaces where punctures are are particular hazard such as landfills. Tires according to the present invention are especially well suited for use with scale model racing cars, such as are commonly radio-controlled and capable of speeds in excess of 40 miles per hour. A tire 10 made according to the present invention is shown in FIG. 1.

Tires are made, according to the present invention, by covering a foam material 12 with a rubber material 14 to form an intermediate composite and heat curing the composite in a mold that resists the expansion of the foam at curing temperatures so that the rubber material fills the mold and the rubber material and the foam material fuse together at their interface.

The rubber material can be a natural rubber or a synthetic rubber or a blend of the two. It may have carbon added as a hardener, colorings, and other standard additives to improve mileage or hardness. The foam material may be any spongy, open or closed cell foam that is chemically stable at the temperature of curing and operation and capable of returning to its original dimensions, a little more or less, after the tire is cured.

Figure 2:
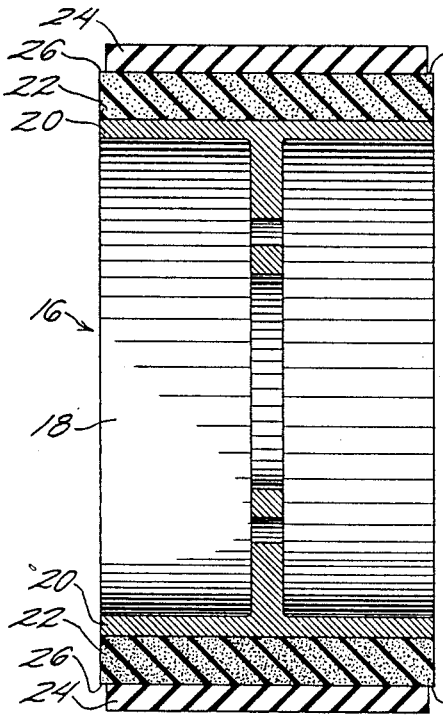
FIG. 2 is a side cross sectional view of a tire according to the present invention before curing.

To make tire 10 according to the present invention, an intermediate composite tire 16 is made formed. For example, in a subscale racing car, tires are made on a wheel 18. Nylon wheels are usually selected for racing cars for their low weight and high strength although metal and other plastics may also be used. In the case of other tires, the tire may be made and later mounted on a wheel. Referring to FIG. 2, wheel 18 has a rim 20. Wheel rim 20 is coated with contact cement and wrapped with a fom strip 22. The ends of foam strip 22 are glued, preferably with a strong or so-called "super" glue to seal the gap. Then foam strip 22 is sanded to the desired outside tolerance. Gluing foam strip 22 makes sanding easier and assures good bonding for tires operated at high speeds.

A coating of rubber cement is applied to the surface of foam strip 22. Then at least one layer of an uncured rubber material 24 is wrapped around the foam carefully so that there are no wrinkles, gaps or voids between the foam and the rubber material, the rubber cement holding rubber material 24 in place. Rubber material 24 may be wrapped under light tension to achieve the desired fit, but not tension sufficient to deform foam 22 significantly. The width of the rubber material 24 should be less than the width of the foam layer, leaving on each side a slight gap 26, 26'. This step completes the formation of an intermediate composite 16.

Intermediate composite tire 16 is placed in a mold. The tire should just fit into a mold (not shown) so that light pressure only is required for seating composite 16 in the mold. The mold should be dimensioned to resist the expansion of foam strip 22 during curing. A mold releaser such as talcum power can be placed on composite 16 to facilitate removal of the tire following curing.

The mold containing composite 16 is then sealed and placed in an oven and heated to a temperature between 180 and 300 degrees Fahrenheit for 40 to 60 minutes depending on application. As the mold comes up to temperature, the foam expands, pushing the rubber into the pores of the foam and filling the mold to give the tire its final form and shape (i.e. treads, roundness, and an oval or flat profile). For scale model racing tires that are to be operated at high speeds, the tire should be only partially cured. At operating speeds the tire will soften with the road friction and be slightly sticky, allowing the car to hold the road better. Preferably, the racing car tire can be cured at a temperature of 232 degrees for 50 minutes to achieve a good consistency. For harder tires, curing at the upper ends of the temperature and time ranges is perferable.

Figure 3:
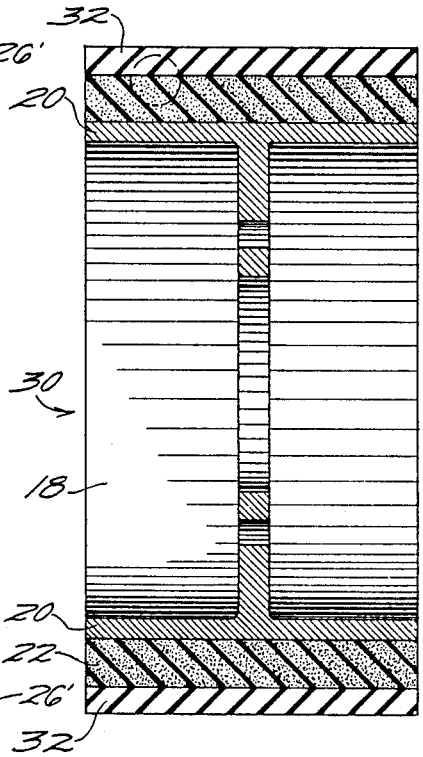
FIG. 3 is a side cross sectional view of a tire according to the present invention after curing.

After curing, intermediate composite tire 16 is a cured tire 30, as shown in FIG. 3. Cured tire 30 is allowed to cool and can then be cleaned. Tire 30 has a cured rubber material layer 32 on foam layer 22 on wheel rim 20. Rubber material 32 will preferably have the same width as the foam material 22, or any other shape as determined by the mold.

Figure 4:
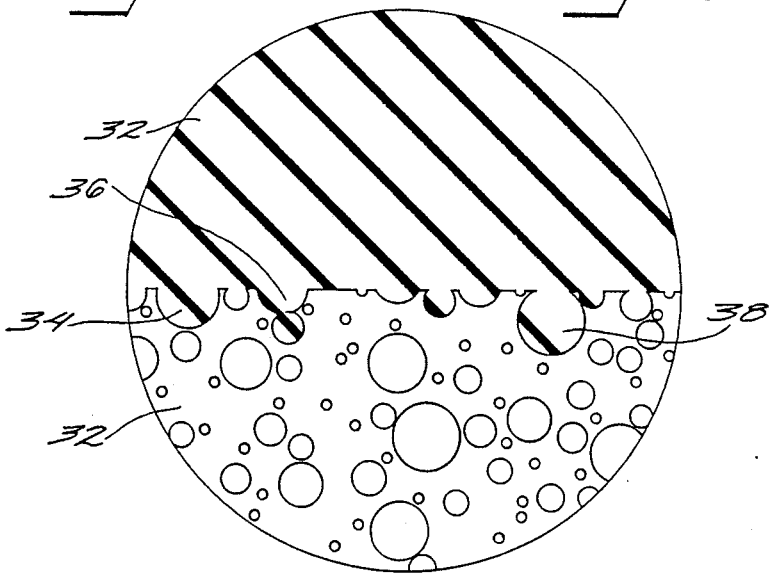
FIG. 4 is a detailed view of segment A of FIG. 3 according to the present invention.

In the oven, the rubber material will fill the mold and, it is believed, fuse to the foam by penetrating the holes in the outer surface of the foam strip to form a tight bond when the foam expands in the oven against the inner surface of the rubber material. As shown in FIG. 4 which is a detailed view of a portion of FIG. 3, rubber material 32 is shown penetrating into holes 34, 36 and 38 to form a fusion of materials at their respective surfaces.

The tire of the present invention can be made in a number of different ways. The amount of the foam and the type of foam and the size of the holes of the foam will determine the cushioning effect. Small holes and a thin foam layer will provide less cushioning than larger holes and a thicker foam layer. Likewise the thickness of the rubber material layer can be varied for the desired application.

As illustrated in FIG. 5, tires made according to the present invention are suited especially for a small scale racing car 40. Car 40 has four tires made in accordance with the above-described process, two of which 42 and 42' are shown in FIG. 5. Car has a frame, two axles, an engine, and a remote control system, preferably radio-transmitted, as indicated by antenna 44 for guiding car 40 and determining speed. Particularly for remotely controlled, and very fast racing cars, tires that have good road hugging characteristics are important. Cars with tires made according to the present invention are believed capable of holding the road at speeds in excess of 55 miles per hour. However, it will be obvious that the present invention may be adapted for other uses, such as bumpers and guards where solid rubber provides insufficient cushioning, pneumatic devices can be punctured and layered materials slide with respect to each other in use and eventually separate.

The foregoing description of preferred embodiments of the invention has been presented for purposes of illustration and description. It is not intended to be exhaustive or to limit the invention to the precise form disclosed, and obviously many modifications and variations are possible in light of the above teachings. The embodiments were chosen and described in order to best explain the principles of the invention and its practical application to thereby enable one skilled in the art to best utilize the invention in various embodiments and with various modifications as are suited to the particular use contemplated. It is intended that the scope of the invention be defined by the claims appended hereto.

What is claimed is:

1. A tire made by a process comprising the steps of:
wrapping at least one layer of a rubber material around a foam core to form an intermediate composite, said rubber material having an inner surface;
placing said intermediate composite in a mold; and
heating said mold to a temperature between 180 and 300 degrees Fahrenheit for 40 to 60 minutes to cure said composite material and to fuse said foam core to said inner surface of said rubber material.

2. The tire of claim 1 further comprising the step of gluing said rubber material to said foam core with rubber cement.

3. The tire of claim 1 wherein said tire is cured at a temperature between 180 and 232 degrees Fahrenheit for 40 to 50 minutes to partially cure said rubber material for increased traction at high speeds.

4. The tire of claim 2 wherein said tire is cured at a temperature between 180 and 232 degrees Fahrenheit for 40 to 50 minutes to partially cure said rubber material for increased traction at high speeds.

5. The tire of claim 1, further comprising the gluing said foam core to a wheel before wrapping said foam core with said rubber material.

6. The tire of claim 2, further comprising the gluing said foam core to a wheel before wrapping said foam core with said rubber material.

7. The tire of claim 3, further comprising the gluing said foam core to a wheel before wrapping said foam core with said rubber material.

8. The tire of claim 4, further comprising the gluing said foam core to a wheel before wrapping said foam core with said rubber material.

9. The tire of claim 5 further comprising the step of sanding said foam core to a desired tolerance before attaching said rubber material.

10. The tire of claim 6 further comprising the step of sanding said foam core to a desired tolerance before attaching said rubber material.

11. The tire of claim 7 further comprising the step of sanding said foam core to a desired tolerance before attaching said rubber material.

12. The tire of claim 8 further comprising the step of sanding said foam core to a desired tolerance before attaching said rubber material.

* * * * *